US011633834B2

(12) United States Patent
Chen et al.

(10) Patent No.: US 11,633,834 B2
(45) Date of Patent: Apr. 25, 2023

(54) METHOD FOR REPAIRING POLISHING PAD IN REAL TIME

(71) Applicant: Ta Liang Technology Co., Ltd., Taoyuan (TW)

(72) Inventors: Chao-Chang Chen, Taoyuan (TW); Jian-Shian Lin, Taoyuan (TW); Chun-Chen Chen, Taoyuan (TW); Jen-Chien Li, Taoyuan (TW); Hsien-Ming Lee, Taoyuan (TW); Ching-Tang Hsueh, Taoyuan (TW)

(73) Assignee: TA LIANG TECHNOLOGY CO., LTD., Taoyuan (TW)

( * ) Notice: Subject to any disclaimer, the term of this patent is extended or adjusted under 35 U.S.C. 154(b) by 296 days.

(21) Appl. No.: 16/992,131

(22) Filed: Aug. 13, 2020

(65) Prior Publication Data

US 2021/0046606 A1 Feb. 18, 2021

(30) Foreign Application Priority Data

Aug. 13, 2019 (TW) ..... 108128756

(51) Int. Cl.
*B24B 53/017* (2012.01)
*B24B 49/00* (2012.01)
*B24B 37/20* (2012.01)

(52) U.S. Cl.
CPC ..... *B24B 53/017* (2013.01); *B24B 37/20* (2013.01); *B24B 49/00* (2013.01)

(58) Field of Classification Search
CPC ..... B24B 53/017; B24B 37/20; B24B 49/00; B24B 53/005
USPC ..... 451/56, 5, 6, 41, 285, 288
See application file for complete search history.

(56) References Cited

U.S. PATENT DOCUMENTS

| | | | | |
|---|---|---|---|---|
| 6,273,793 | B1 * | 8/2001 | Liners | B24B 33/08 451/63 |
| 7,020,306 | B2 * | 3/2006 | Hirose | B24B 49/12 382/145 |
| 8,221,193 | B2 * | 7/2012 | Chang | B24B 53/017 451/6 |
| 2005/0090185 | A1 * | 4/2005 | Fujishima | B24B 53/017 451/6 |
| 2008/0287043 | A1 * | 11/2008 | Saito | B24B 53/017 451/285 |

FOREIGN PATENT DOCUMENTS

| | | |
|---|---|---|
| JP | 2005088128 | 4/2005 |
| JP | 2019040918 | 3/2019 |
| TW | 201436944 | 10/2014 |

* cited by examiner

*Primary Examiner* — Anne M Kozak
*Assistant Examiner* — Shantese L Mcdonald
(74) *Attorney, Agent, or Firm* — JCIPRNET

(57) ABSTRACT

A method for repairing a polishing pad in real time includes a trimming step, a detection step, and a reconstruction and analysis step. A surface morphology of the polishing pad is reconstructed through detection, and analysis is performed according to the reconstruction, to ensure that a surface of the polishing pad can recover its function after the surface of the polishing pad is trimmed, so that the polishing pad can be used effectively to reduce costs.

2 Claims, 4 Drawing Sheets

METHOD FOR REPAIRING POLISHING PAD IN REAL TIME

CROSS-REFERENCE TO RELATED APPLICATION

This application claims the priority benefit of Taiwan application serial no. 108128756, filed on Aug. 13, 2019. The entirety of the above-mentioned patent application is hereby incorporated by reference herein and made a part of this specification.

BACKGROUND OF THE INVENTION

1. Field of the Invention

The invention relates to a method for repairing a polishing pad in real time, and in particular, to a method for repairing a polishing pad in a chemical mechanical polishing apparatus by means of surface morphology reconstruction.

2. Description of Related Art

The chemical mechanical polishing apparatus may perform uniform polishing on a highly composite material by combining the principles of chemical and mechanical polishing. The polishing pad of the chemical mechanical polishing apparatus necessarily requires surface trimming after a period of time of use, to maintain the polishing capacity of the polishing pad. In the existing manner of repairing a polishing pad, the polishing pad is trimmed and replaced according to the life time provided by the polishing pad manufacturer or the user's experience. In general, after the polishing pad is used for a certain period of time, the polishing pad is trimmed in a certain groove depth by a dresser. However, polishing pad wears caused by different polishing processes are different. If the polishing pad wear is relatively low, the polishing pad may have a problem of waste. If the wear of polishing pad is relatively high, the trimming thickness may be insufficient.

Therefore, how to resolve the foregoing conventional problems and deficiencies is the subject that a person skilled in the art urgently needs to research and develop.

SUMMARY OF THE INVENTION

The invention is mainly directed to reconstructing a surface morphology of a polishing pad through detection, and analyzing according to the reconstruction, to ensure that a surface of the polishing pad can recover its function after being repaired, and the thickness of the polishing pad is not wasted, so that the polishing pad may be used effectively to reduce costs.

To achieve the foregoing objective, a method for repairing a polishing pad in real time according to the invention includes following steps.

A trimming step: rotating the polishing pad through a base, pressing a dresser to abut against a surface of the polishing pad, and shifting the dresser toward an inner side or an outer side of the polishing pad, so as to trim the surface of the polishing pad.

A detection step: keeping the polishing pad rotating; and shifting a detection apparatus above the polishing pad toward the inner side or the outer side of the polishing pad, so that the detection apparatus continuously detects the polishing pad and transmits detection data to a host end.

A reconstruction and analysis step: performing, by the host end, a surface morphology reconstruction on the polishing pad according to the detection data transmitted by the detection apparatus, and then analyzing according to a result of the surface morphology reconstruction.

According to the foregoing method for repairing the polishing pad in real time, the analysis performed by the host end according to the result of the surface morphology reconstruction in the reconstruction and analysis step is a surface roughness analysis of the polishing pad. When the result of the surface roughness analysis is insufficiency, the polishing pad is subjected to the trimming step and the detection step again, until the surface roughness of the polishing pad analyzed in the reconstruction and analysis step is sufficient.

According to the foregoing method for repairing the polishing pad in real time, the analysis performed by the host end according to the result of the surface morphology reconstruction in the reconstruction and analysis step is a groove depth analysis of the polishing pad. When the result of the groove depth analysis is insufficiency, a message of replacing the polishing pad is sent out.

According to the foregoing method for repairing the polishing pad in real time, the detection apparatus includes a detector configured to detect the surface of the polishing pad and an isolator configured to form an isolation area in a polishing solution layer by means of gas injection to expose the polishing pad.

According to the foregoing method for repairing the polishing pad in real time, the isolator of the detection apparatus has a gas nozzle configured to inject gas, where the gas injection range of the gas nozzle includes a detection position of the detector.

According to the foregoing method for repairing the polishing pad in real time, the detection apparatus is further provided with a shifter, where the shifter includes a driving unit and a swing arm connected to the driving unit. The detector and the isolator are connected to the swing arm, and the driving unit drives the swing arm to make the detector and the isolator shifted above the polishing pad toward the inner side or the outer side of the polishing pad horizontally in a linear or arc-shaped manner.

According to the foregoing method for repairing the polishing pad in real time, the detector of the detection apparatus is a confocal microscope or a photosensitive coupling element.

According to the foregoing method for trimming the polishing pad in real time, the detection apparatus in the detection step detects the polishing pad continuously at a fixed or non-fixed detection frequency. When the detection apparatus shifts above the polishing pad toward the inner side or the outer side of the polishing pad, the shift speed is a variable speed.

DESCRIPTION OF THE EMBODIMENTS

Figure 1:
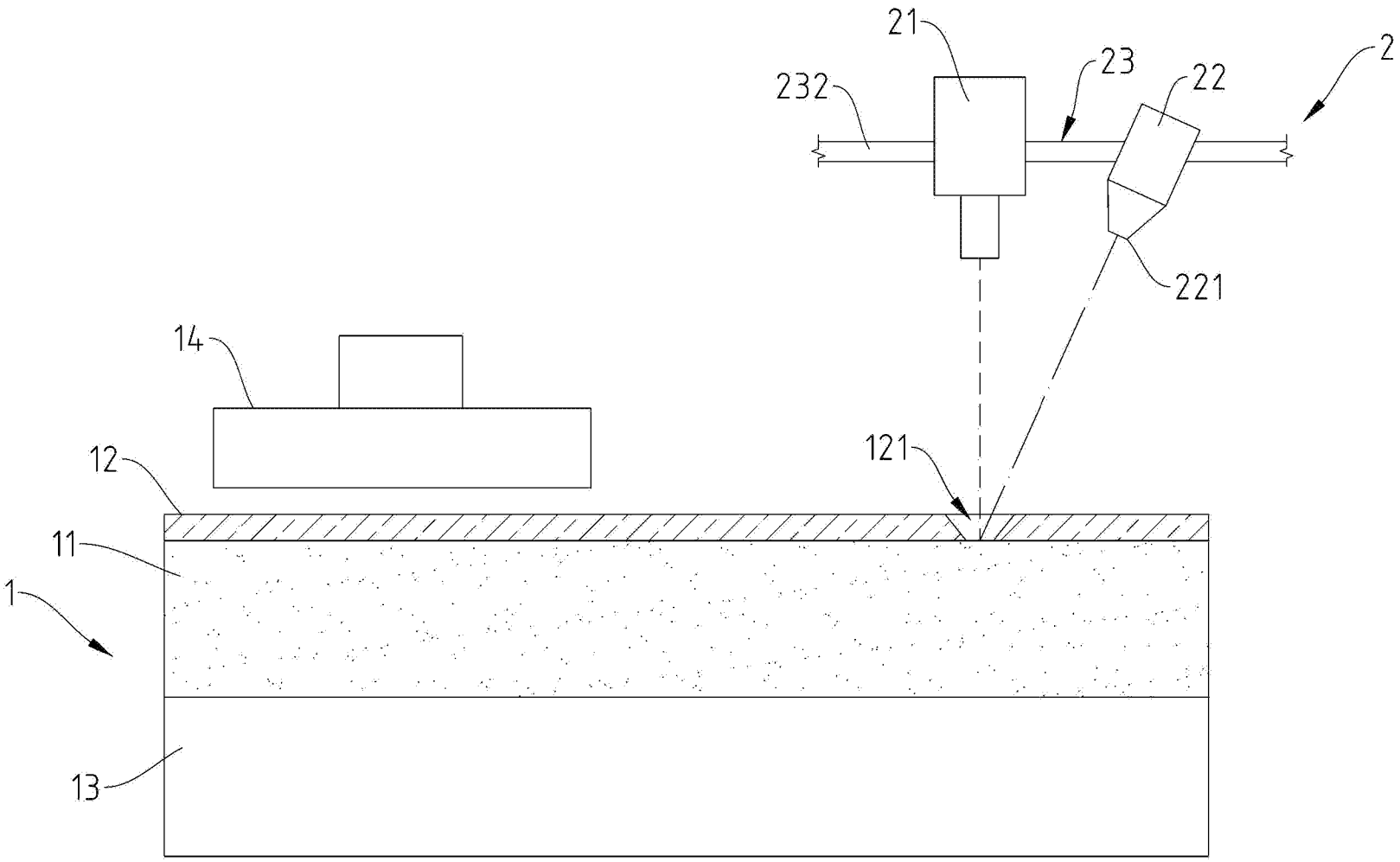
FIG. 1 is a schematic detection diagram of a detection apparatus according to the invention.
Figure 2:
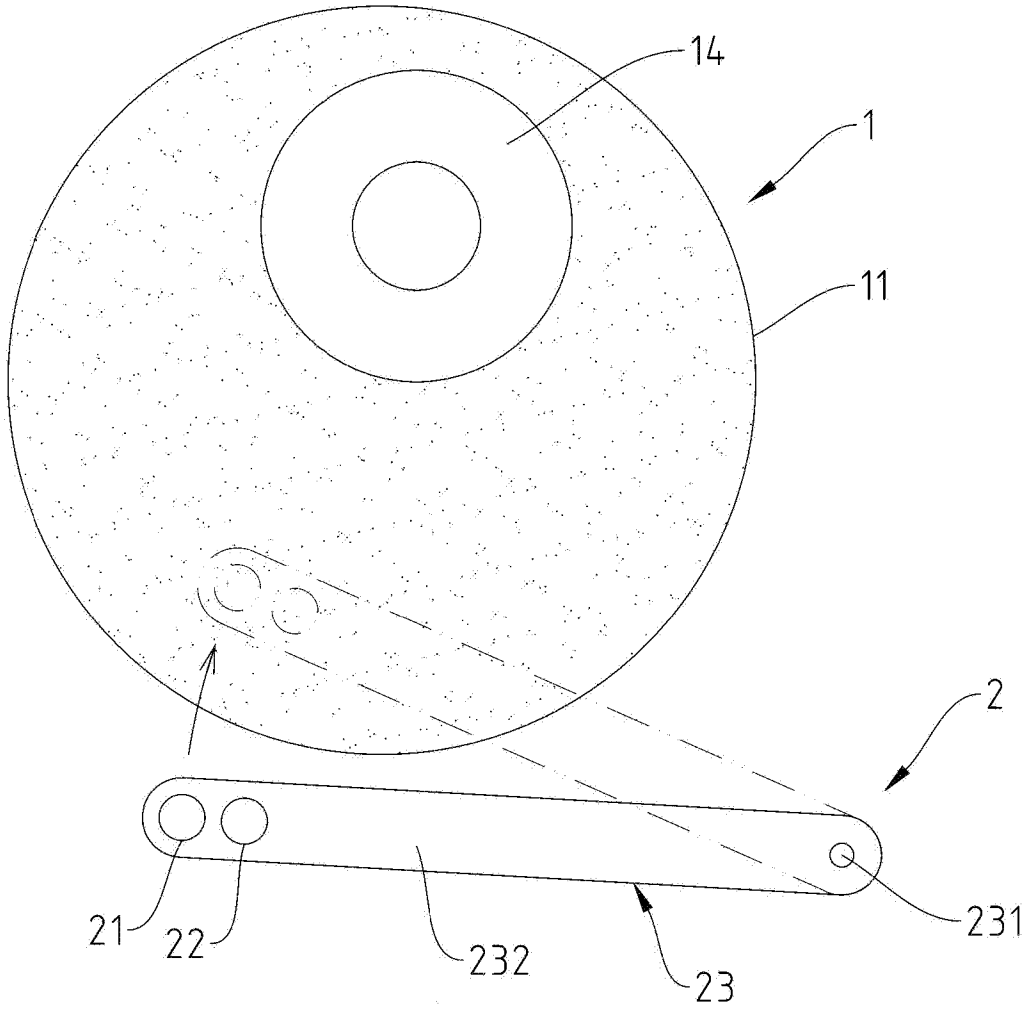
FIG. 2 is a schematic swing diagram of a swing arm of the detection apparatus according to the invention.
Figure 3:
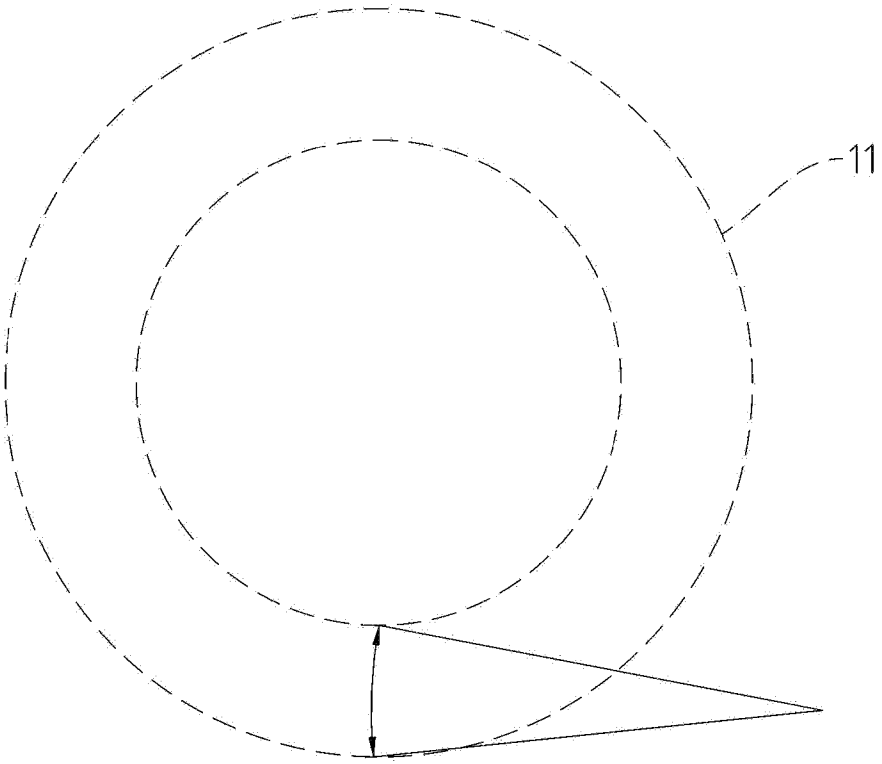
FIG. 3 is a schematic diagram of trajectory reconstruction of the invention.

Referring to FIG. 1 to FIG. 3, it can be clearly seen from the figures that the invention is provided with a chemical mechanical polishing apparatus 1 and a detection apparatus 2.

The chemical mechanical polishing apparatus 1 has a polishing pad 11, a polishing solution layer 12, a base 13, and a dresser 14. The polishing pad 11 is positioned to cover on the base 13. The polishing solution layer 12 covers the surface of the polishing pad 11. The dresser 14 is located above the polishing pad 11.

The detection apparatus 2 has a detector 21, an isolator 22, and a shifter 23. The shifter 23 has a driving unit 231 and a swing arm 232 connected to the driving unit 231. The detector 21 and the isolator 22 are connected to the swing arm 232.

The polishing pad 11 is repaired according to the following steps.

(A) A trimming step: rotating the polishing pad 11 through the base 13; pressing the dresser 14 to abut against a surface of the polishing pad 11; and shifting the dresser 14 toward an inner side or an outer side of the polishing pad 11, so as to trim a surface of the polishing pad 11. Step (B) is performed subsequently after finishing the trimming step.

(B) A detection step: keeping the polishing pad 11 rotating; shifting the detection apparatus 2 above the polishing pad 11 toward the inner side or the outer side of the polishing pad 11 horizontally, so that the detection apparatus 2 continuously detects the polishing pad 11 at a fixed or non-fixed detection frequency, and transmits detection data to a host end; and step (C) is performed.

(C) A reconstruction and analysis step: performing, by the host end, a surface morphology reconstruction on the polishing pad 11 according to the detection data transmitted by the detection apparatus 2, and then performing surface roughness and groove depth analysis according to a result of morphology reconstruction. When the result of the surface roughness analysis is insufficiency, the polishing pad 11 is subjected to the trimming step (A) and the detection step (B) again, until the surface roughness of the polishing pad analyzed in the reconstruction and analysis step (C) is sufficient. When the result of groove depth analysis is insufficiency, a message of replacing the polishing pad 11 is sent out, so that a user replaces the polishing pad 11.

Moreover, since the tangent speeds of the inner side and the outer side of the polishing pad 11 are different while the polishing pad 11 is rotated, and the detection apparatus 2 continuously detects the polishing pad 11 at a fixed detection frequency, the shift speed is gradually accelerated to make the distance between two adjacent detection positions equal while the detection apparatus 2 shifts toward the inner side of the polishing pad 11. The shift speed slows down gradually while the detection apparatus 2 shifts toward the outer side of the polishing pad 11. The host end may reconstruct an intact surface morphology of the polishing pad 11 according to the detection trajectory by using the shift speed of the detection apparatus 2 as a variable speed.

Furthermore, the detection apparatus 2 has a detector 21, an isolator 22, and a shifter 23. The shifter 23 has a driving unit 231 and a swing arm 232 connected to the driving unit 231. The detector 21 and the isolator 22 are connected to the swing arm 232, and the swing arm 232 drives the detector 21 and the isolator 22 to shift toward the inner side or the outer side of the polishing pad 11 horizontally in an arc-shaped manner. When the detection apparatus 2 detects the surface of the polishing pad 11, a gas nozzle 221 of the isolator 22 may inject gas to a detection position of the detector 21, and an isolation area 121 is formed in the polishing solution layer 12 by means of airflow to expose the polishing pad 11, so that the detector 21 may detect the position exposed by the isolation area 121. The detector 21 may be an optical sensing element such as a confocal microscope or a photosensitive coupling element.

Figure 4:
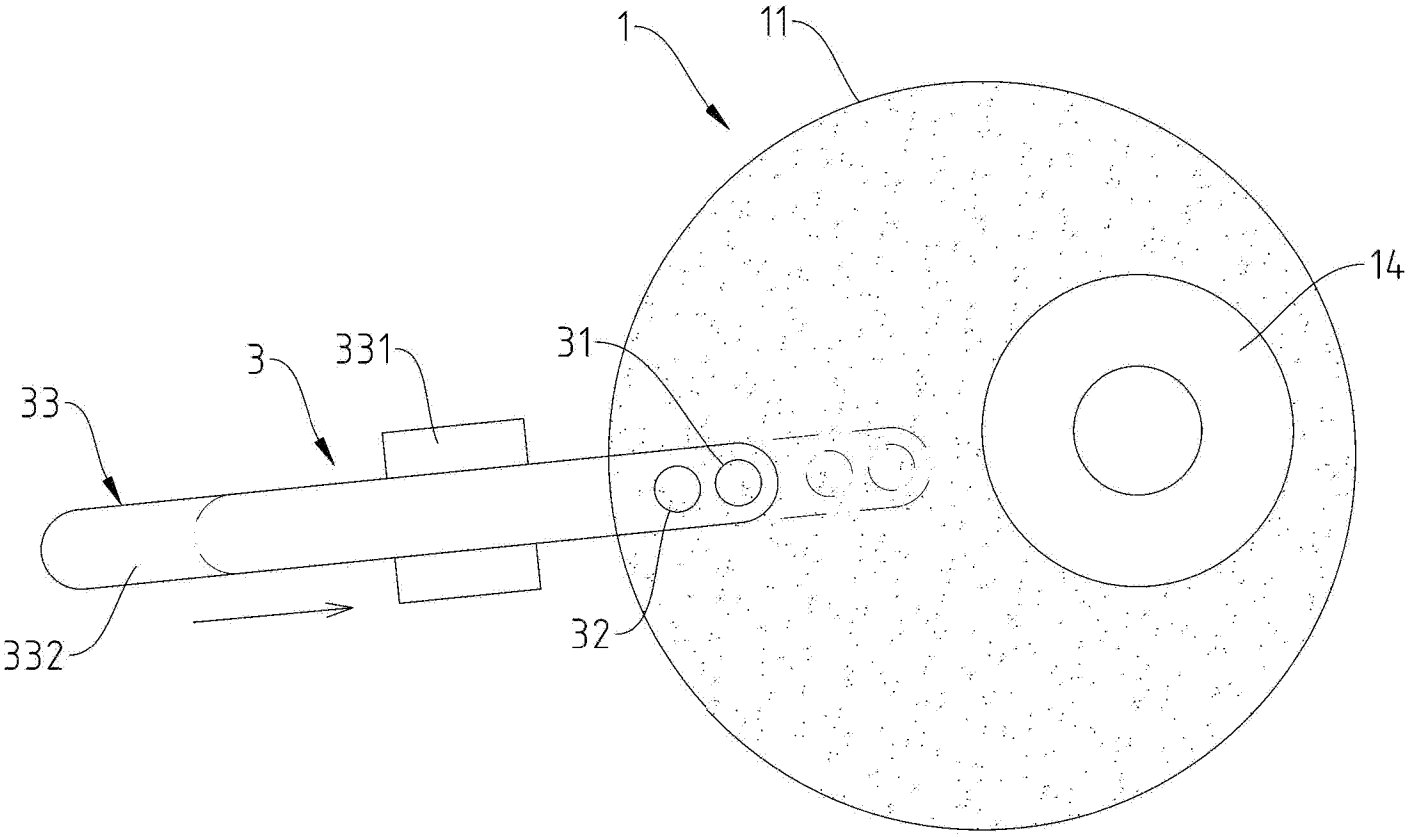
FIG. 4 is a schematic shift diagram of a shift arm of another embodiment of the detection apparatus according to the invention.

Referring to FIG. 4, it can be clearly seen from the figure that the difference between another embodiment of the detection apparatus 3 of the invention and the foregoing embodiment is that a shifter 33 of the detection apparatus 3 has a driving unit 331 and a shift arm 332 connected to the driving unit 331, the shift arm 332 is driven by the driving unit 331 to shift toward the inner side or the outer side of the polishing pad 11 horizontally in a linear manner, so that the isolator 32 injects gas to the detection position of the detector 31, and the detector 31 may detect the polishing pad 11.

What is claimed is:

1. A method for repairing a polishing pad in real time, comprising:

a trimming step: rotating the polishing pad through a base, pressing a dresser to abut against a surface of the polishing pad, and shifting the dresser toward an inner side or an outer side of the polishing pad, so as to trim the surface of the polishing pad;

a detection step: keeping the polishing pad rotating, and shifting a detection apparatus above the polishing pad toward the inner side or the outer side of the polishing pad, so that the detection apparatus continuously detects the polishing pad and transmits detection data to a host end; and a reconstruction and analysis step: performing, by the host end, a surface morphology reconstruction on the polishing pad according to the detection data transmitted by the detection apparatus, and then analyzing according to a result of the surface morphology reconstruction, wherein the detection apparatus comprises a detector, an isolator, and a shifter, and the shifter comprises a driving unit and a swing arm connected to the driving unit, and the detector and the isolator are directly connected to the swing arm, wherein the driving unit drives the swing arm to make the detector and the isolator shifted above the polishing pad toward the inner side or the outer side of the polishing pad horizontally in an arc-shaped manner, and the isolator forms an isolation area in a polishing solution layer by means of gas injection to expose the polishing pad, so that the detector detects the surface of the polishing pad, and wherein the detection apparatus is shifted with a first shift speed being gradually increased while the detection apparatus is shifted toward the inner side of the polishing pad, and the detection apparatus is shifted with a second shift speed being gradually decreased while the detection apparatus is shifted toward the outer side of the polishing pad.

2. A method for repairing a polishing pad in real time, comprising:

a trimming step: rotating the polishing pad through a base, pressing a dresser to abut against a surface of the polishing pad, and shifting the dresser toward an inner side or an outer side of the polishing pad, so as to trim the surface of the polishing pad;

a detection step: keeping the polishing pad rotating, and shifting a detection apparatus above the polishing pad toward the inner side or the outer side of the polishing pad, so that the detection apparatus continuously detects the polishing pad and transmits detection data to a host end; and a reconstruction and analysis step: performing, by the host end, a surface morphology reconstruction on the polishing pad according to the detection data transmitted by the detection apparatus, and then analyzing according to a result of the surface morphology reconstruction, wherein the detection apparatus comprises a detector, an isolator, and a shifter, and the shifter comprises a driving unit and a swing arm connected to the driving unit, and the detector and the isolator are directly connected to the swing arm, wherein the driving unit drives the swing arm to make the detector and the isolator shifted above the polishing pad toward the inner side or the outer side of the polishing pad horizontally in a linear manner, and the isolator forms an isolation area in a polishing solution layer by means of gas injection to expose the polishing pad, so that the detector detects the surface of the polishing pad, and wherein the detection apparatus is shifted with a first shift speed being gradually increased while the detection apparatus is shifted toward the inner side of the polishing pad, and the detection apparatus is shifted with a second shift speed being gradually decreased while the detection apparatus is shifted toward the outer side of the polishing pad.

* * * * *